US007673880B2

(12) United States Patent
McNellis

(10) Patent No.: US 7,673,880 B2
(45) Date of Patent: Mar. 9, 2010

(54) DIE RETRIEVAL GAME

(76) Inventor: Timothy W. McNellis, 409 Martin Ter., State College, PA (US) 16803

( * ) Notice: Subject to any disclaimer, the term of this patent is extended or adjusted under 35 U.S.C. 154(b) by 56 days.

(21) Appl. No.: 12/220,043

(22) Filed: Jul. 21, 2008

(65) Prior Publication Data

US 2009/0026702 A1 Jan. 29, 2009

Related U.S. Application Data

(60) Provisional application No. 60/961,465, filed on Jul. 23, 2007.

(51) Int. Cl.
*A63F 3/00* (2006.01)

(52) U.S. Cl. ..... 273/243; 273/248

(58) Field of Classification Search ..... 273/243, 273/248

See application file for complete search history.

*Primary Examiner*—Vishu K Mendiratta

(57) ABSTRACT

The present invention relates to a game wherein the objective is to retrieve a special die from a specific location and return with it to the starting point on the playing surface. The game is designed to maximize feelings of competition and suspense among those playing by providing both the incentive and the means for players to interfere with the progress of other players. The player having the special die has the advantage of being able to roll the special die in addition to the regular die. The special die returns to its original location when the player in possession of it is caught by another player. Some playing surface locations hinder movement by requiring specific die rolls before movement off of the location is permitted. Other locations promote movement by allowing additional rolls of the dice. All players have a chance to win the game until the very end.

7 Claims, 1 Drawing Sheet

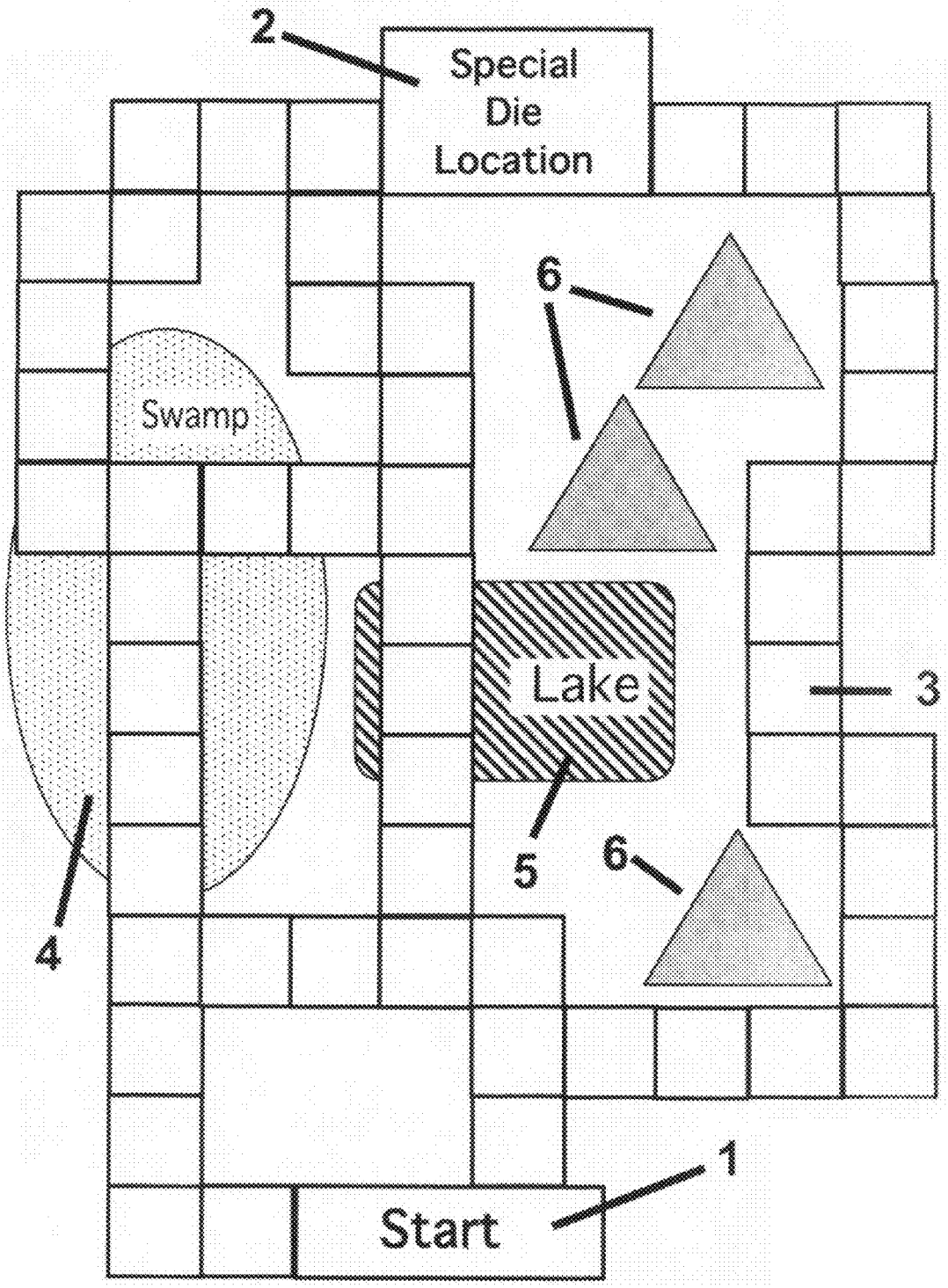
2
Special
Die
Location
6
Swamp
Lake
3
5
6
4
1
Start

DIE RETRIEVAL GAME

CROSS-REFERENCE TO RELATED APPLICATIONS

This application claims the benefit of U.S. Provisional Patent Application No. 60/961,465, filed on Jul. 23, 2007.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

The subject matter of this claim is a game to be used for entertainment purposes.

BRIEF SUMMARY OF THE INVENTION

This invention is a game wherein the objective is to retrieve a special die from a specific location and return with it to the starting point. There are numerous obstacles and hazards between the starting point and the location of the special die. Movement is determined by the results of die rolls. The game is designed to maximize feelings of competition and suspense among those playing.

BRIEF DESCRIPTION OF THE SEVERAL VIEWS OF THE DRAWING

FIG. 1 shows an exemplary playing surface for the present invention.

The following is a list of numbers and the parts of the invention to which they refer, as illustrated in FIG. 1.

1 The starting point.

2 The location of the special die.

3 Network of game spaces that provide a plurality of potential routes between the start point and the location of the special die.

4 A "swamp" obstacle.

5 A "lake" obstacle.

6 A "mountains" obstacle

DETAILED DESCRIPTION OF THE INVENTION

The present invention relates to a game wherein the objective is to retrieve a special die from a specific location and return with it to the starting point. The player having the special die rolls two dice for movement while the other players roll only one, the special die returns to its original location when the player in possession of it is caught, some playing surface locations hinder movement by requiring specific die rolls for departure, and some playing surface locations provide long-range movement only when a player has the special die. There are also various obstacles on the playing surface, such as a mountain pass with numerous switchbacks, a lake that can only be crossed by boat, and a swamp that contains numerous locations that hinder movement by requiring specific die rolls for departure.

The game is designed to maximize feelings of competition and suspense among those playing from the game's beginning up until the final move. This is done by providing both the incentive and the means for a player or team of players to interfere with the progress of the other players or teams of players. In addition, all players or teams of players to have a chance to win the game up until the very end of the game.

Game Design

As shown in FIG. 1, the inventive game is played on a playing surface that includes a starting point 1 and a location where the special die can be retrieved by a player or team of players 2. The starting point and the location of the special die are connected by a network of game spaces 3 that provide a plurality of potential routes between the start point and the location of the special die. The playing surface material includes but is not limited to cardboard, classic game board, paper, cloth, or any other surface or material onto which FIG. 1 could be transposed.

Some spaces marked on the board hinder movement by requiring a specific die roll to be made before movement off the space is allowed. This die roll is hereafter called a "pre-roll". A "pre-roll" is a roll of a die that is made before the die roll for movement is made. The "pre-roll" requires that a particular number or one of a set of numbers are rolled. If the required "pre-roll" result is not obtained, then the player can not move on that turn and the next player takes their turn. The required "pre-roll" result can have a success probability ranging from 50% to approximately 15%. For example, some spaces might require a "pre-roll" result of 1, 2, or 3, for a success probability of 50% if a six-sided die is used. Some spaces marked on the board allow the player to roll the die again and move further if their playing piece lands on that space.

Some spaces marked on the board send a player's or playing team's playing piece back to the start point if their playing piece lands on that space. Some spaces marked on the board allow the playing piece that lands on that space to move to any similarly marked space anywhere on the board, but only when a player is in possession of the special die. Otherwise, these spaces do nothing special to help or hinder movement of playing pieces that land on them. Some spaces allow the player or team of players whose playing piece comes to rest upon them to roll their die or dice again and move again. This provides for further movement and die rolls than are otherwise allowed. There are also several obstacles between the starting position and the location of the special die, including, but not limited to, a swamp with numerous spaces that require "pre-rolls" 4, a lake that can only be crossed by boat and that contains numerous whirlpools that send playing pieces back to the starting point 5, and a mountain pass with numerous switchbacks 6.

Game Play

Each player or group of players forming a team moves their playing piece or pieces around the game playing surface on their turn according to the result of the roll of a die. Suitable playing pieces include but are not limited to a token, chess pawn, coin, or any object that can mark a player's position on the game playing surface.

The objective of the game is to for each player, or group of players forming a team, to 1) move their playing piece or pieces from a starting position at one end of the board to a particular location at the opposite end of the board to retrieve the special die, and 2) move their playing piece or pieces back to the starting point with the special die, thereby winning the game. Exemplary special dice include six-, eight-, or ten-sided dice. The game may be played with dice of any polyhedral form.

Any player, or team of players, may send the playing piece or playing pieces of another player or team of players back to the starting point by landing his playing piece on the space occupied by another player's playing piece. One may land his playing piece on the space occupied by another's playing piece only by rolling the dice and moving the corresponding number of spaces.

The player possessing the special die may roll two dice on his turn and can choose the best result for movement on the game board. That is, the player or team of players possessing the special die may roll the special die in addition to the regular die, whereas a player or team of players not possessing the special die may only roll one regular die upon their turn.

There is only one special die, so only one player may be in possession of the special die at any given time. If a player or team of players lands with their playing piece on the space occupied by the playing piece of the player or team of players in possession of the special die, then the special die must be returned to its original location on the board and the playing piece of the player or team of players formerly in possession of the special die must return to the starting point. The special die can then be retrieved again by the first player who reaches it with their playing piece.

The game ends when the player or team of players in possession of the special die returns their playing piece to the starting point on the playing surface, and hence such player wins the game. The game can also be won by scoring sufficient points. This second manner of winning the game ensures that game play will not proceed indefinitely if no player or team of players is able to retrieve the special die and bring it back to the starting point. Points are scored by a player or team of players that retrieves the special die. Additional points are scored by the player or team of players in possession of the special die as that player's or team of players' playing piece moves past certain marked locations on the board on the way back to the starting point. The closer the playing piece of the player or team of players in possession of the special die gets to the starting point, the more points that player or team of players scores. In addition, a player or team of players who sends back to the starting point the playing piece or pieces of the a player or team of players in possession of the special die also scores points.

However, the points that can be scored during a single possession of the special die are insufficient to win the game. That is, the primary objective of the player or team of players possessing the special die is always to return to the starting point. However, if the player or team of players possessing the special die is caught before returning to the starting point, they still have points that they scored during the period of play during which they possessed the special die. With several possessions of the special die, a player or team of players can win the game by acquiring sufficient points, even if they never successfully return to the starting point with the special die. For example, six points may be required to win the game, but a player or team of players that has retrieved the special die can only score a maximum of four points before reaching the start point and winning the game. Therefore, a player or team of players wins by either successfully reaching the start point with their playing piece while in possession of the special die, or, if they are caught by the other players, by retrieving the special die again and scoring additional points sufficient to win the game.

In addition, it is possible that a player or team of players might win by bringing the special die back to the start point, even though that player or team of players might have scored fewer points at the time that they bring the special die back to the starting point than some of the other players in the game who failed to bring the special die back to the starting point. For example, it is possible for a player or team of players to win by bringing the special die back to the start point and scoring four points, beating the player or team of players who has scored five points as a result of multiple possessions of the special die, but who has not been able to return to the start point with the special die.

This detailed description provides the specific details necessary to understand the invention. However, small modifications can be made to this game design without changing the spirit and scope of the invention. The present invention is not limited to this precise description, but also includes variations that are possible within the scope of the claims described below.

What is claimed is:

1. A method of game play wherein the objective is to retrieve a special die from a specific location on the playing surface and return with it to the starting point, comprising the steps of:

a) providing a playing surface with a starting point, a location of the special die, and a plurality of routes connecting the two;

b) each player using a playing piece to represent their player space position on the playing surface;

c) players selecting a first player;

d) the first and subsequent players each sequentially moving their playing piece across the board for numbers of game spaces determined by their roll of a die or dice;

e) each player following game instructions based on the space on which their playing piece comes to rest;

f) certain play spaces along the routes on the playing surface hindering or promoting the movement of the playing piece that comes to rest on said spaces;

g) any player landing with their playing piece on the space occupied by any other player's playing piece sends the other player's playing piece back to the starting point;

h) the player landing with their playing piece at the location of the special die on the playing surface taking possession of the special die;

i) the player possessing the special die being permitted to roll the special die in addition to the regular die or dice in order to determine the movement of said player's playing piece;

j) the player possessing the special die being permitted to roll the special die in addition to the regular die or dice under any circumstances during play when that player is required to roll a die or dice;

k) when a player lands with their playing piece on the playing surface space occupied by the playing piece of the player in possession of the special die, the player in possession of the special die surrenders possession of the special die, returns the special die to the special die location on the playing surface, and returns their playing piece to the starting point;

l) winning the game is achieved by the player in possession of the special die when said player's playing piece comes to rest on the starting location on the playing surface;

m) an alternative method of winning the game is by scoring a pre-determined number of points awarded according to the distance moved in the direction of the starting location on the playing surface by the playing piece of the player possessing the special die; however, points are awarded in such a way as to make it impossible to score sufficient points to win the game during a single possession of the special die.

2. The method of game play recited in claim 1, further disclosing wherein certain of said playing spaces marked on the playing surface hinder movement of the playing pieces that come to rest on said spaces by requiring a specific die roll to be made before movement of said pieces off of said spaces is permitted.

3. The method of game play recited in claim 1, further disclosing wherein certain of said playing spaces marked on the playing surface hinder movement of the playing pieces that come to rest on said spaces by sending playing pieces that come to rest on said spaces back to the starting location on the playing surface.

4. The method of game play recited in claim 1, further disclosing wherein certain of said playing spaces marked on the playing surface promote movement of the playing pieces that come to rest on said spaces by allowing the players possessing said playing pieces to roll the die or dice again and move said playing pieces again.

5. The method of game play recited in claim 1, further disclosing wherein certain of said playing spaces marked on the playing surface promote movement of the playing pieces that come to rest on said spaces by allowing the players possessing said playing pieces to move said playing pieces to any other similarly marked space on the playing surface.

6. The method of game play recited in claim 1, further disclosing wherein said special die can be possessed by only one player at a time.

7. The method of game play recited in claim 1, further disclosing wherein a player whose playing piece comes to rest at the special die location on the playing surface does not come into possession of the special die at such times when another player is already in possession of the special die.

* * * * *